US006077133A

United States Patent [19]

Kojima et al.

[11] Patent Number: 6,077,133

[45] Date of Patent: Jun. 20, 2000

[54] LOCKING DEVICE FOR OUTBOARD MOTOR

[75] Inventors: Akinori Kojima; Masaru Suzuki, both of Hamamatsu, Japan

[73] Assignee: Sanshin Kogyo Kabushiki Kaisha, Hamamatsu, Japan

[21] Appl. No.: 09/112,561

[22] Filed: Jul. 9, 1998

[30] Foreign Application Priority Data

Jul. 9, 1997 [JP] Japan ..... 9-183322
Feb. 26, 1998 [JP] Japan ..... 10-045181

[51] Int. Cl.[7] ..... B63H 21/22

[52] U.S. Cl. ..... 440/1; 440/113

[58] Field of Search ..... 440/1, 84, 85, 440/113

[56] References Cited

U.S. PATENT DOCUMENTS 2,909,146 10/1959 Strang ..... 440/85
5,441,022 8/1995 Yoder et al. ..... 123/179.3
5,637,022 6/1997 Koike et al. ..... 440/87

*Primary Examiner*—Sherman Basinger
*Attorney, Agent, or Firm*—Knobbe, Martens, Olson & Bear LLP

[57] ABSTRACT

Several embodiments of improved security systems for marine propulsion systems that do not have a continuously available source of electrical energy. These systems include an electric key reader that is powered by a manually operated electrical power supply during starting so as to ensure against theft. In one embodiment, if there is a failure in the electrical power supply for the security system, the speed of the propulsion system is limited so that a rightful owner can reach an area where service can be obtained.

12 Claims, 7 Drawing Sheets

LOCKING DEVICE FOR OUTBOARD MOTOR

BACKGROUND OF THE INVENTION

This invention relates to a marine propulsion system such as an outboard and more particularly to an improved locking device for such a marine propulsion system.

Marine propulsion systems such as outboard motors are generally readily detachable from the hull of the associated watercraft which they power. This means that an outboard motor is a device that can be relatively easily operated or taken by a person that is not the owner. Thus, various types of locking devices have been proposed for precluding this from happening. The locking devices commonly use all key and tumbler locking mechanisms. These locking mechanisms are relatively easy to defeat, however.

With automotive and other types of vehicle systems, a type of security system is employed in which the key is electrically or magnetically coded either alone or in combination with being keyed to operate a tumbler mechanism. These types of devices are much more difficult to defeat.

However, this type of locking mechanism requires a continuously available source of electric power to be present in the vehicle that is locked or controlled. By "continuously available source of electrical power," as utilized in this specification and in the claims, reference is made to a source of electric power that is continuously available whether the engine in the primer mover is operating or not. Conventionally, this source of power is a storage battery although other electrical sources are possible.

Most outboard motors, however, do not have such continuously available sources of electrical power. Therefore, this type of locking device has not been utilized with outboard motors or other forms of marine propulsion units.

It is, therefore, a principal object of this invention to provide an improved locking system for a marine propulsion system that utilizes a magnetically or electrically coded key for controlling the operation of the prime mover.

It is a further object of this invention to provide a marine propulsion unit of the type that can be provided with a security device that requires an electrically or magnetically coded key for its operation.

SUMMARY OF THE INVENTION

This invention is adapted to be embodied in an anti-theft system for a marine propulsion system. The marine propulsion system has a prime mover, a main propulsion device driven by the prime mover and a security device for controlling the operation of the prime mover for preventing unauthorized control thereof. The security device has the capability of permitting an operator to control the operation of the prime mover upon the presentation of a suitably coded key. The security device has a reading device for reading the key that requires a source of electrical power for its operation. The marine propulsion system is devoid of any continuously available source of electrical power. An operator controlled source of electrical power is provided in the marine propulsion system so that any operator may generate sufficient electrical power for the security device to read the key.

DETAILED DESCRIPTION OF THE PREFERRED EMBODIMENTS OF THE INVENTION

Figure 1:
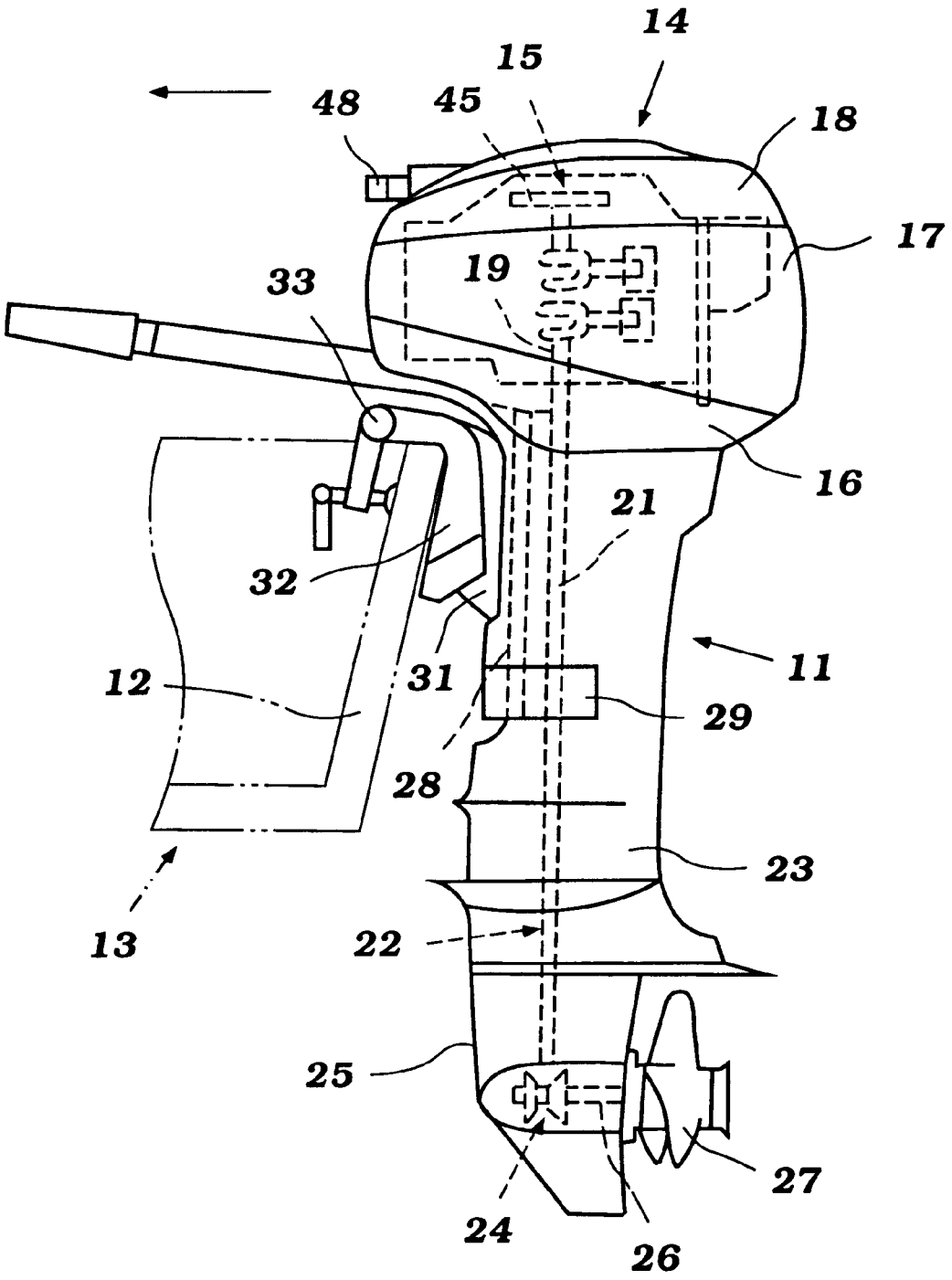
FIG. 1 is a side elevational view of an outboard motor embodying the invention.

Referring first to FIG. 1, an outboard motor is illustrated in this figure and is identified generally by the reference numeral 11. The outboard motor 11 is shown as attached to the transom 12 of an associated watercraft hull which is shown partially in phantom and which is identified generally by the reference numeral 13.

The invention is described in conjunction with an outboard motor such as the outboard motor 11 and the showing in FIG. 1 may be considered to be typical of the environment in which the invention can be utilized. Each of the embodiments described herein can be employed in such an environment.

Although the invention has particular utility with outboard motors, it can be used with other types of marine propulsion devices. The invention, however, has particular utility with the type of marine propulsion device wherein the prime mover does not have a continuously available source of electrical energy, as should be apparent from the background portion of this application.

The outboard motor 11 is comprised of a powerhead, indicated generally by the reference numeral 14. The powerhead 14 is comprised of a powering internal combustion engine 15 which is surrounded within a protective cowling having a lower tray portion 16, a main body portion 17 and a cover portion 18. These components may be formed from any type of materials known in the art.

As is typical with outboard motor practice, the engine 15 is mounted in the powerhead 14 so that its crankshaft 19 rotates about a vertically extending axis. This is done so as to facilitate coupling of the crankshaft 19 to a drive shaft 21 which forms a portion of a propulsion device indicated generally by the reference numeral 22. The drive shaft 21 is journaled within a drive shaft housing 23 that depends from the powerhead 14.

The propulsion device 22 further includes a bevel gear type of forward, neutral, reverse transmission 24 that is mounted in a lower unit 25. The lower unit 25 may be a separate piece or formed integrally with the drive shaft housing 23. The bevel gear reversing transmission 24 can selectively drive a propeller shaft 26 in forward or reverse directions, as is well known in this art. A propeller 27 is affixed to the rear end of the propeller shaft 26 and completes the propulsion device 22 for propelling the associated watercraft hull 13.

A steering shaft 28 is affixed to the drive shaft housing 23 by means that include a lower bracket 29. This steering shaft 28 is journaled for steering movement in a swivel bracket 31. This steering movement permits the direction of propulsion by the propeller 27 to be changed for steering of the watercraft 13 in a manner that is well known in this art.

The swivel bracket 31 is, in turn, connected to a clamping bracket 32 by means of a pivot pin 33. This pivotal connection permits tilt and trim movement of the outboard motor 11 in a manner which is also well known in the art.

Figure 2:
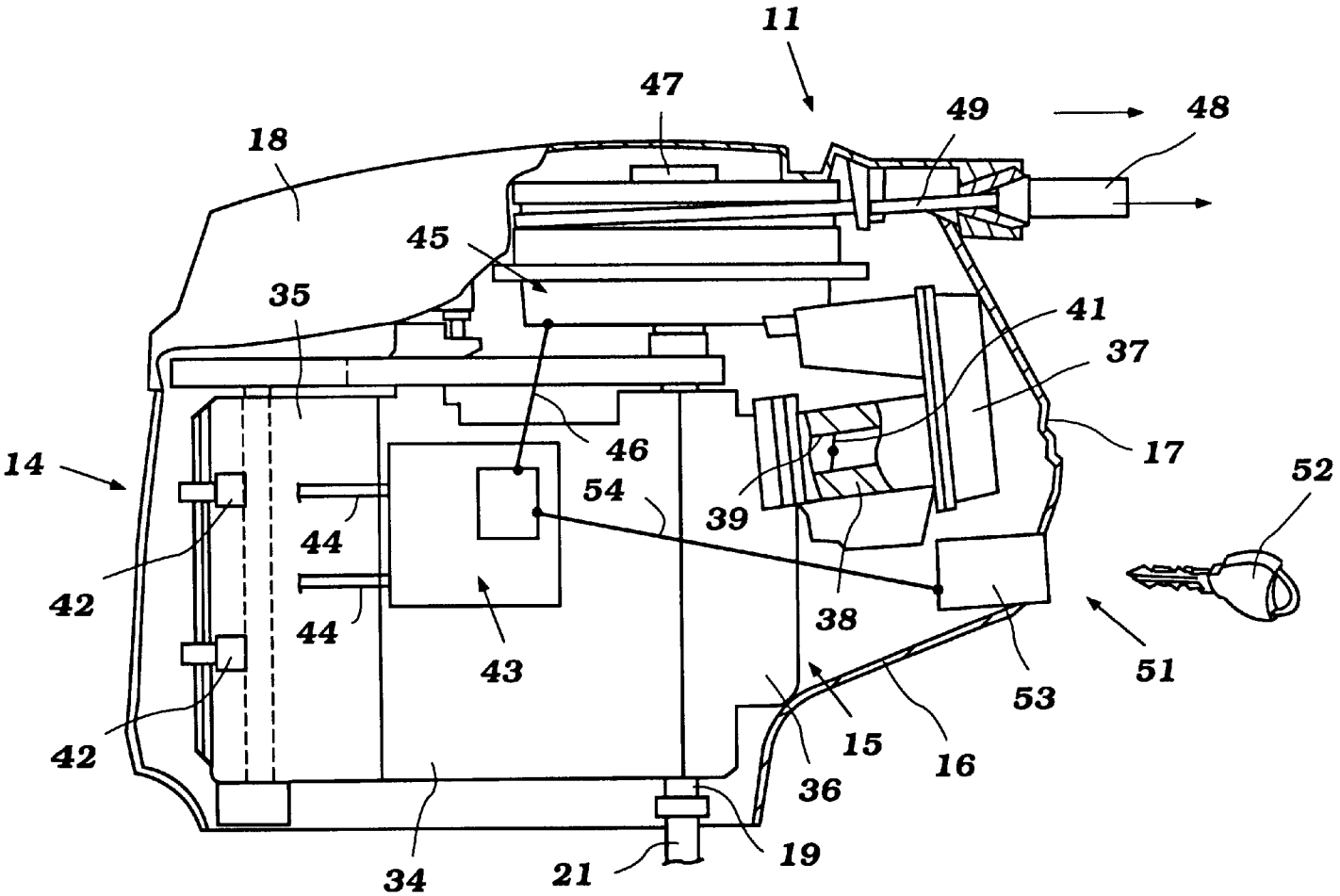
FIG. 2 is an enlarged side elevational view of the powerhead of the outboard motor looking in a direction opposite FIG. 1 and with portions broken away and showing the security system and illustrating the key associated therewith in perspective.

Referring now additionally to FIG. 2, some further components of the outboard motor are shown in more detail and will be described. These include primarily details dealing with the construction of the engine 15. In this embodiment, the engine 15 is depicted as being of a two cylinder, in-line type. It will be readily apparent to those skilled in the art, however, that the invention can be utilized with a wide variety of types of engines both in cylinder number, cylinder orientation, and operating cycle.

The engine 15 includes a cylinder block 34 that forms cylinder bores that are closed at one end by a cylinder head assembly 35 that is detachably connected to the cylinder block 34 in any known manner. A crankcase member 36 is affixed to and closes the other ends of the cylinder bores and defines a crankcase chamber in which the crankshaft 19 is rotatably journaled.

An induction system delivers an air/fuel charge to the engine 15. This induction system includes an air inlet device 37 that draws atmospheric air from within the protective cowling and which delivers it to a charge former such as a carburetor 38. The carburetor 38 has induction passages 39 and which throttle valves are provided for controlling the speed of the engine in a well known manner.

The engine 15 is also spark ignited and spark plugs 42 are mounted in the cylinder head 35 for firing the charge which has been admitted to the combustion chambers. The spark plugs 42 are fired by an ignition system, indicated generally by the reference numeral 43 through spark plug terminals 44.

A flywheel magneto assembly, indicated generally by the reference numeral 45, is affixed to the upper end of the crankshaft 19 and supplies electrical power and ignition timing control information to the ECU 43 through a conductor indicated schematically at 46.

A recoil-type pull starter mechanism 47 is affixed to the upper end of the flywheel magneto assembly 45 for pull starting of the engine 15. A pull starter handle 48 is connected by a starter rope 49 to the recoil mechanism 47 for pull starting operation in a manner well known in the art.

The construction of the outboard motor 11 as thus far described may be considered to be conventional. Since the invention deals primarily with the security or locking system for the outboard motor 11, more detail of the construction of the outboard motor 11 is not believed to be necessary to permit those skilled in the art to practice the invention. Where any component is not shown or described, resort may be had by those skilled in the art to any known structure with which to practice the invention.

The security system is indicated generally by the reference numeral 51 and includes a key 52 that is placed into a slot in a key reader and/or tumbler mechanism 53. The mechanism 53 includes a reading device for reading coded magnetic information placed on the key 52 to determine if an authorized user is attempting to operate the outboard motor 11. This information is transmitted to the ECU 43 through a conductor 54. This mechanism forms the heart of the invention and will now be described in more detail by reference to FIG. 3 wherein it is shown schematically and FIG. 4 wherein the control strategy is illustrated and will be described.

Figure 3:
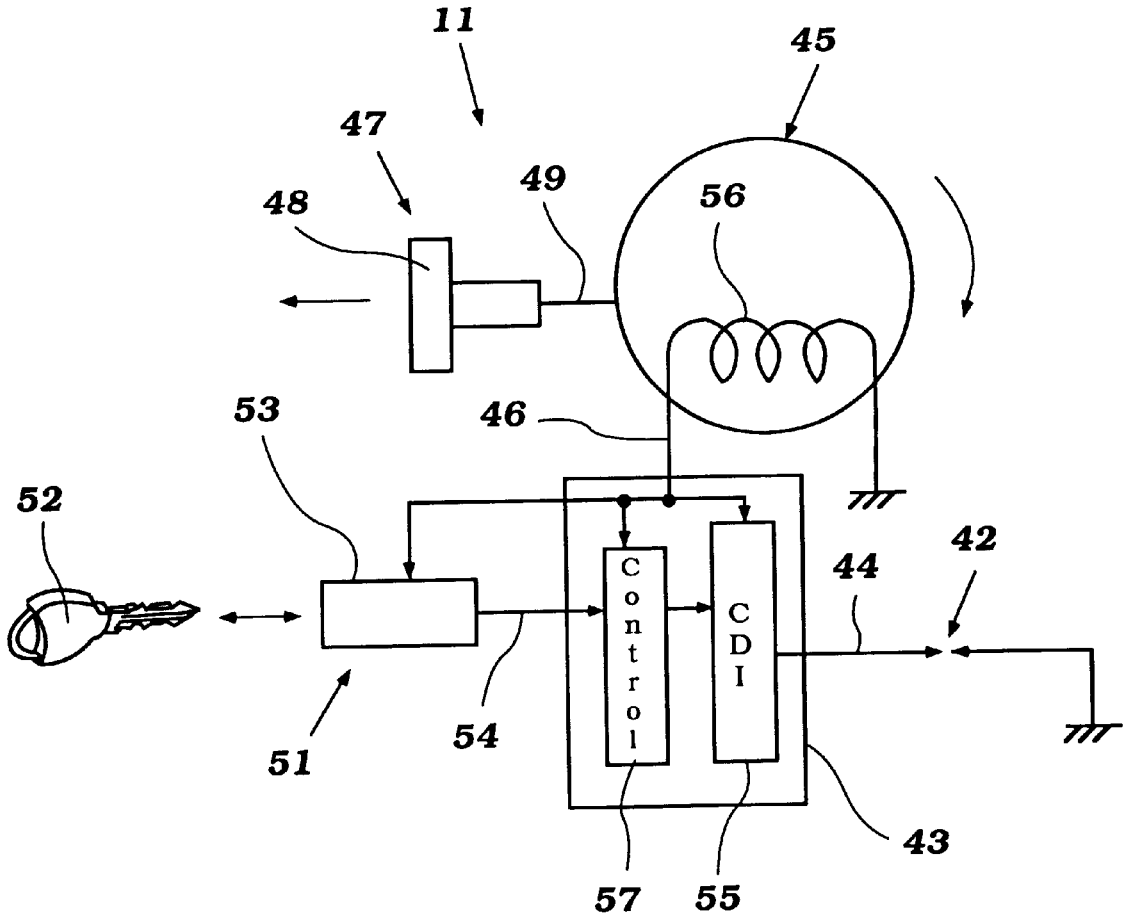
FIG. 3 is a schematic view showing the security system of this embodiment.

As may be seen in FIG. 3, the control unit 43 includes an ignition system, indicated generally by the reference numeral 55 which may be of any known type and which is powered by a charging coil 56 of the magneto generator 45. The magneto generator 45 and specifically the charging coil 46 also outputs an electrical potential to both the key reader 53 and a control unit 57 that receives the information from the key reader 53.

Basically, the way the system operates is that the operator places the key 52 in the key reader 53. He then generates sufficient electrical energy so as to permit the key to be read by pulling the pull starter handle 48. This causes the flywheel magneto generator 45 to generate sufficient potential in the charging coil 56 to enable the control 57 and the reader 53.

If the key matches the preset code in the control 57, the ignition circuit 55 is enabled and the spark plugs 42 will be fired so as to permit starting of the engine. If the wrong key is presented, then the control will not turn on the ignition circuit 55 and the engine cannot be started.

Also, if the key 52 is removed from the reader 53, the ignition circuit 56 will be disabled and the engine will be stopped. Of course, it would be possible to insert a holding circuit and then employ a separate kill switch for stopping the engine if that was desired.

Figure 4:
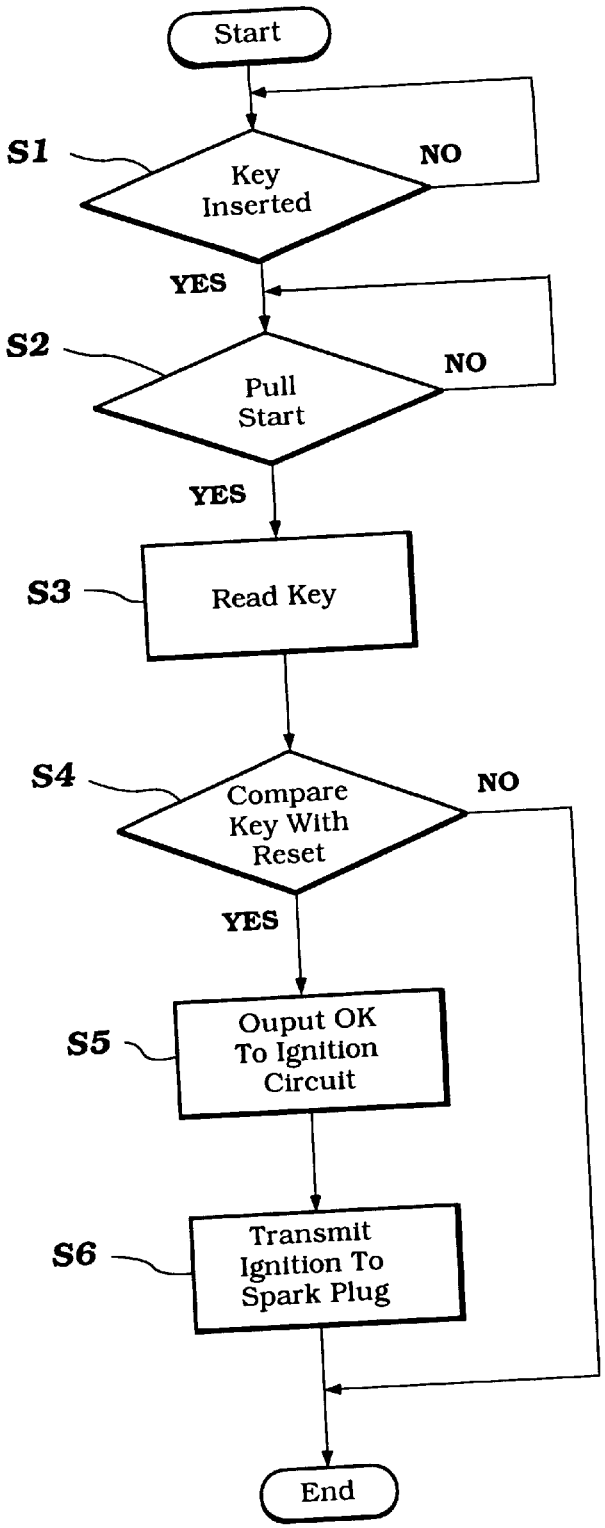
FIG. 4 is a block diagram showing the control routine for this security system embodiment.

The control routine will now be described by specific reference to FIG. 4. At the first step S1, the key 52 is inserted. Once the key is inserted, the program can continue otherwise it will return.

Once the key 52 is inserted, then the operator will initiate the starter operation by pulling the starter handle 48 and rope 49. If this is not done, the program will repeat.

Assuming the operator has inserted the key and pulled the starter rope, then the program moves to the step S3 wherein the output from the reader, which is now energized, will be read and transmitted to the control 57 in the manner previously described. At the step S4, the key reading is transmitted to the control 57 and compared with the preprogrammed information. If the key is not the proper key, the program moves to the end.

If, however, the proper key is in place, then at the step S5, the control 57 will output an enable signal to the ignition circuit 55 to permit it to operate. Then the ignition circuit 55 will fire the spark plugs at the appropriate time at the step S6 and the engine presumably will start.

Figure 5:
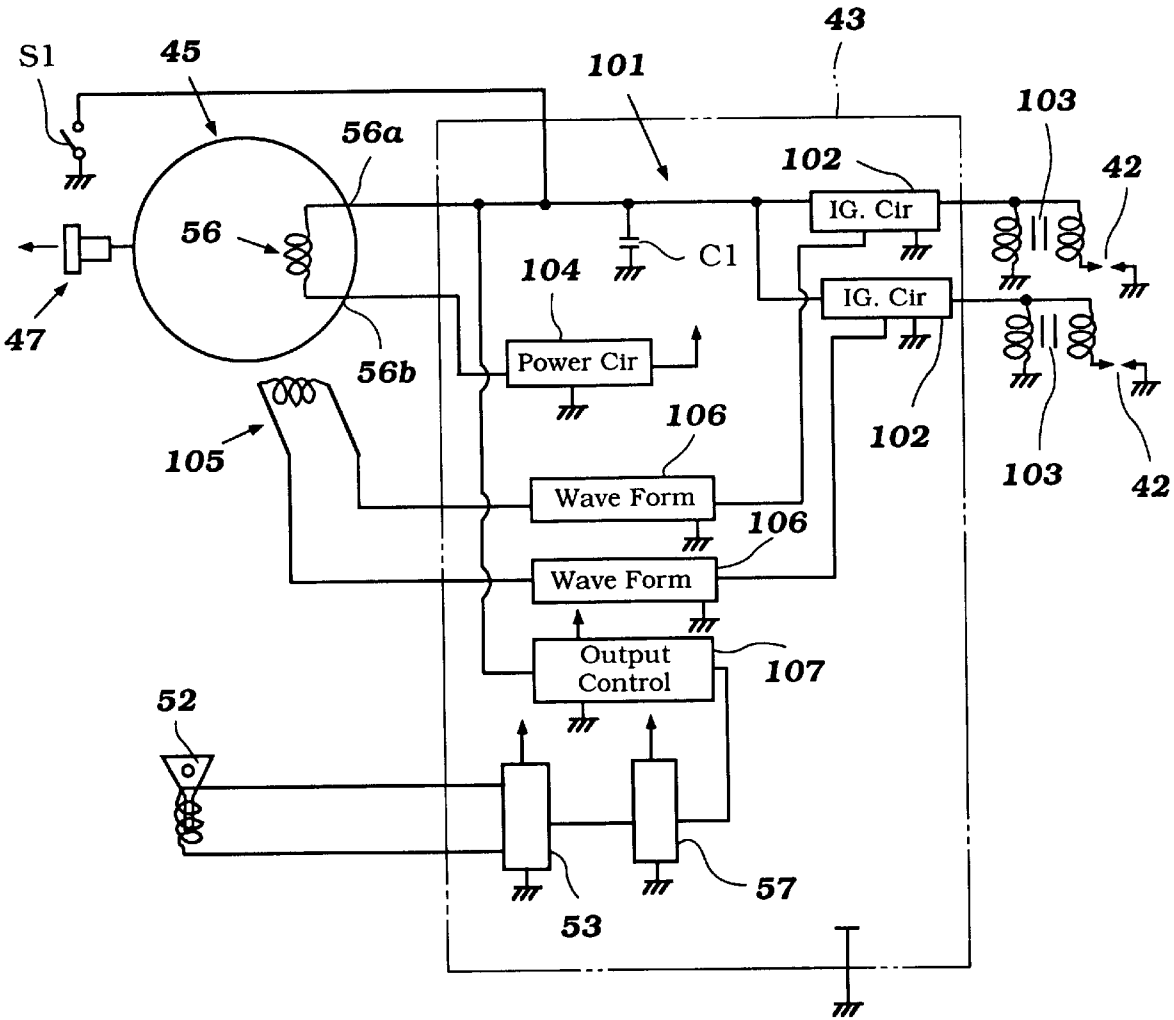
FIG. 5 is a schematic electrical diagram, in part similar to FIG. 3 and shows a second embodiment of the invention.

FIG. 5 shows another embodiment of the invention which is generally the same as the embodiment previously described but shows the utilization with a CDI ignition system. In this embodiment, the charging coil 56 has a first terminal 56*a* that is connected to the ignition system, indicated in this embodiment by the reference numeral 101. This ignition system 101 includes a charging capacitor C1 and a pair of ignition circuits 102 each of which supplies an output to the primary winding of a respective spark coil 103. These coils 103 have their secondary windings connected to the spark plugs 42 in the manner previously described.

The charging coil 56 has a secondary terminal 56*b* that supplies electrical power to a power circuit 104. This power circuit 104 may supply electrical to other components as desired.

The ignition circuit further includes a pulser coil 105 that is associated with the flywheel magneto 45 and which outputs a triggering pulse indicative of crank angle. This output signal is transmitted to a pair of wave-forming circuits 106 which, in turn, output triggering signals to the ignition circuits 102 so as to permit discharge to the capacitor and firing of the spark plugs 42 in the manner well known in the art.

In this embodiment, the key reader 53 transmits its signal to the controller 57 which in turn switches the output controller 107 on or off so as to control the output from the wave-forming circuits 106 to the ignition circuits 102. If their output is not enabled, the engine will not start.

In this embodiment, there is also provided a kill switch indicated at SI for stopping the engine even when the key 52 is in the reader 53.

In some instances, it may be desirable to provide a security system wherein the engine of the outboard motor may be permitted to operate but only within certain limits under certain specific conditions. Said another way, the control that is established over the engine 15 by the security system described need not be merely one that permits the engine to run or not run but rather one that controls the parameters within which the engine may run.

Figure 6:
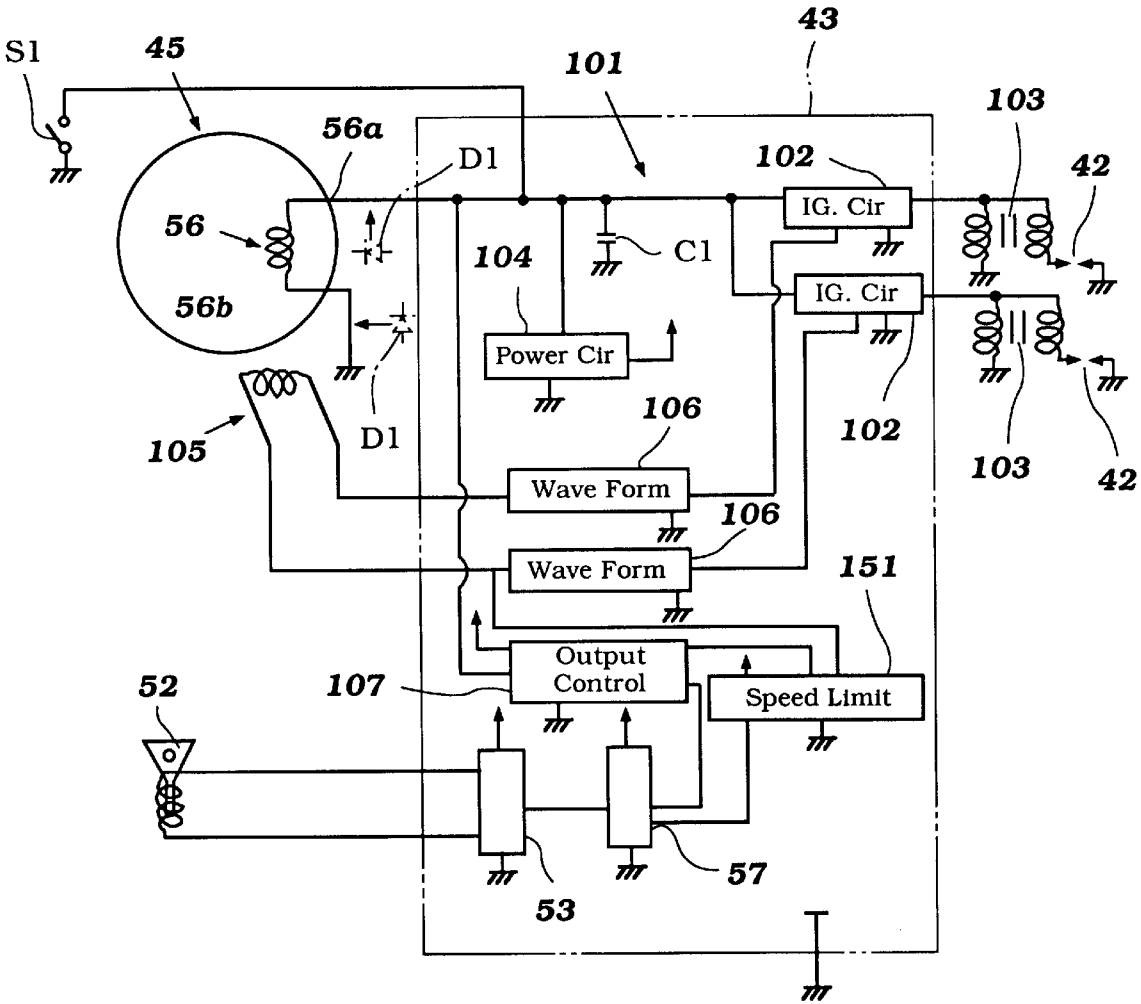
FIG. 6 is a view in part similar to FIGS. 3 and 5 and shows a third embodiment of the invention.
Figure 7:
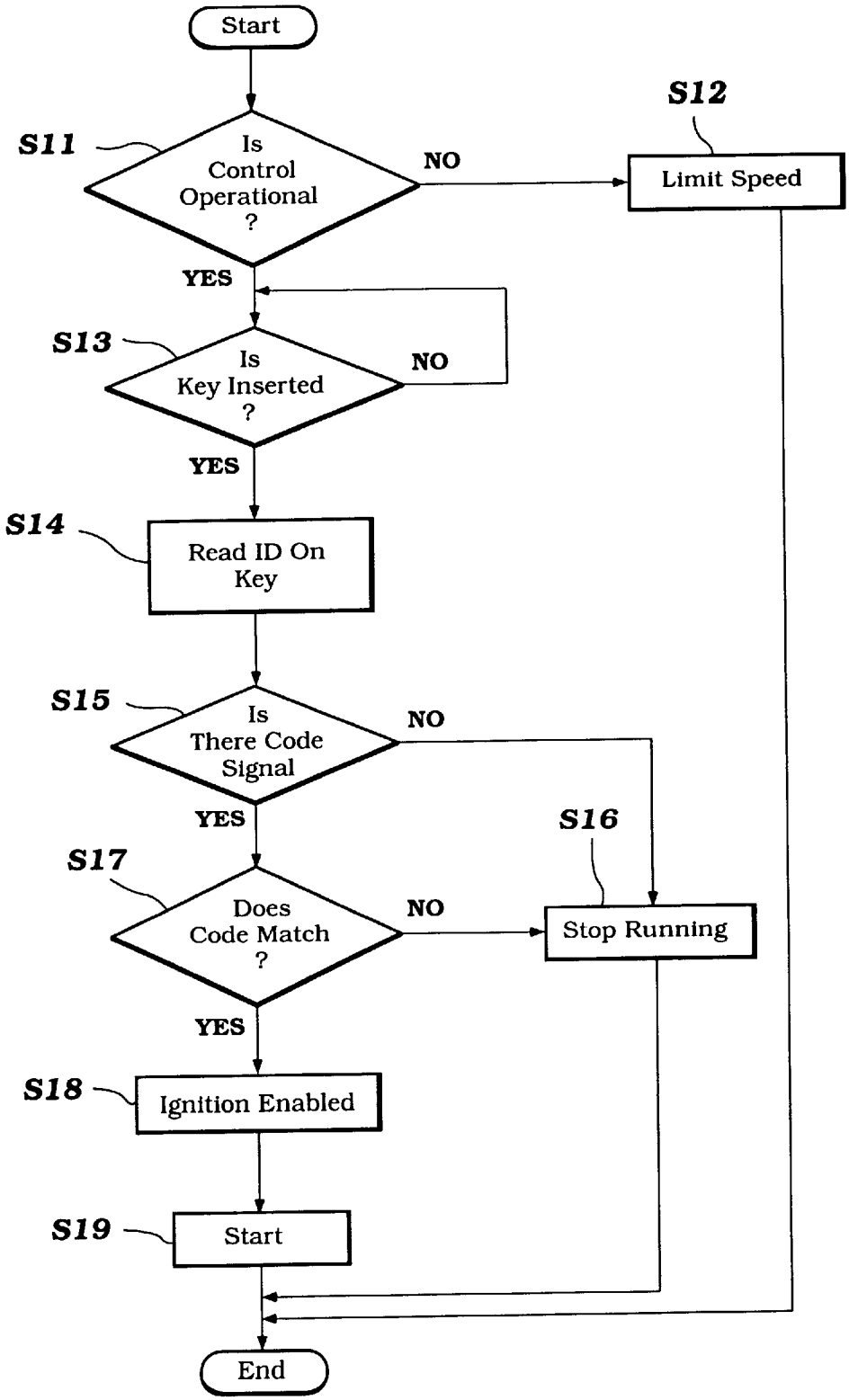
FIG. 7 is a block diagram showing the control routine for this third embodiment.

FIGS. 6 and 7 show such an embodiment. In this embodiment, the security system permits the engine to run but limits the running speed to a relatively low speed if there is a failure in the electrical system. If the control system and specifically the output control 107 or the key sensor is inoperative either because of a defect in the electrical circuit or an attempt is made to defeat it are examples of such failures. In this way, the operator or rider will not become stranded. However, by limiting the speed it ensures security against theft because a wrongful user would not be able to make a rapid escape.

In this embodiment, the control circuit is basically the same as the circuit shown in FIG. 5. Therefore, where components are the same, they have been identified by the same reference numerals in FIG. 6 and will not be described again, except insofar as is necessary to permit those skilled in the art to understand how this embodiment works.

This embodiment has a further control section which is a speed limiting section, indicated generally by the reference numeral 151 and which is connected to the output control 107 and also to the ignition circuits and specifically the trigger mechanisms 106. When this system 151 is enabled, it limits the number of firings permitted for the engine so as to limit the speed of the outboard motor 11 to achieve the aforenoted effect.

In this control routine, as shown in FIG. 7, the program starts at the step F11 so as to determine that the control output 107 is operating. It may be that a thief knowing of the existence of the security system can disable part of the control so that when the pull starter is operated, electrical power will not be supplied to the control output 107. This will then defeat the security system.

Thus, if the operator pulls the starter handle at the step F11, then the determination of an output signal to the output control can be checked. If there is no signal, the system moves to the step S12 wherein the speed limiter 151 is enabled and the running of the engine is limited to a very low speed. This is a speed that will permit the rightful owner to be able to travel to an area where repairs can be made but will be slow enough that a thief will not be able to effect an escape.

If, however, at the step S11, it is determined that the control is operational, then the program moves to the step S13 which is basically the same as the step S1 of the previous routine to see if a key is inserted. If one is not, the program repeats.

If, however, at the step S13 it is determined that a key is inserted then the program moves to the step S14 to read the specific ID of the inserted key. At the Step S15 it is determined if the key has a coded signal. If not the program moves to the step S16 to stop the ability of the engine to run by disabling the ignition circuit.

If at the step S15 there is a code signal, the program then moves to the step S17 to compare the reading of the key with the preprogrammed code. This is basically the same as the step S4 from the previous embodiment.

If the improper key is inserted, then the program jumps to the step S16 so as to initiate a stop signal and discontinue the output from the output control that enables the ignition circuit. Thus, no running is possible, not even under a reduced speed.

If, however, at the step S17 it is determined that the code is proper, then the program moves to the step S18 and ignition is enabled. The program then moves to the step S19 wherein the engine is permitted to start and normal operation can ensue.

Thus, from the foregoing description it should be readily apparent that the described embodiments of the invention can provide a very effective security system for a marine propulsion system that does not have a continuously available source of electrical energy. Furthermore, in one embodiment the system is operative to permit a rightful owner to operate the boat to a safety condition is for some reason the electrical system fails to operate so as to achieve the verification of proper ownership. However, the speed is so low that a thief cannot actually make off with the propulsion unit. Of course, the foregoing description is that of preferred embodiments of the invention and various changes and modifications can be made without departing from the spirit and scope of the invention, as defined by the appended claims.

What is claimed is:

1. An anti-theft system for a marine propulsion system having a prime mover having no association with an external source of electrical energy and devoid of an internal electrical energy storage device, a marine propulsion unit driven by said prime mover, a security device for controlling the operation of said prime mover for precluding unauthorized use thereof, said security device being operative to permit an operator to control the operation of said prime mover upon the presentation of a suitably coded key, said security device requiring a source of electrical power for its operation, and means independent of an electrical storage supply apart from said prime mover for generating an electrical power for operating the security device to enable said security device to determine whether the appropriate key is presented.

2. An anti-theft system for a marine propulsion system as set forth in claim 1, wherein the prime mover is a spark ignited internal combustion engine having an ignition system and the security device controls the operation of said ignition system for firing a spark plug of said engine.

3. An anti-theft system for a marine propulsion system as set forth in claim 2, wherein the ignition system includes a magneto generator.

4. An anti-theft system for a marine propulsion system as set forth in claim 3, wherein the magneto generator is associated with a pull starter for manual starting of the engine.

5. An anti-theft system for a marine propulsion system as set forth in claim 4, wherein the source of electrical power supplied comprises the magneto generator.

6. An anti-theft system for a marine propulsion system as set forth in claim 2, further including means for determining if the security device is operative and for limiting the speed of the engine in the event the security device is inoperative.

7. An anti-theft system for a marine propulsion system as set forth in claim 6, wherein the security device totally disables engine running if the security device becomes operative and an appropriately coded key is not presented to the security device.

8. An anti-theft system for a marine propulsion system as set forth in claim 1, wherein the source of electrical power is enabled upon an attempt to start the prime mover.

9. An anti-theft system for a marine propulsion system as set forth in claim 8, wherein the prime mover has a pull starter.

10. An anti-theft system for a marine propulsion system as set forth in claim 9, wherein the pull starter drives an electrical generator to provide the electrical power.

11. An anti-theft system for a marine propulsion system as set forth in claim 10, wherein the prime mover is a spark ignited internal combustion engine having an ignition system and the security device controls the operation of said ignition system for firing a spark plug of said engine.

12. An anti-theft system for a marine propulsion system as set forth in claim 11, wherein the electrical generator comprises a magneto generator that also powers the ignition system.

* * * * *